US009056508B2

(12) United States Patent
Tsuchiya et al.

(10) Patent No.: US 9,056,508 B2
(45) Date of Patent: Jun. 16, 2015

(54) PRINTER APPARATUS INCLUDING A FIXED BLADE PUSHED TOWARD A MOVABLE BLADE

(71) Applicant: FUJITSU COMPONENT LIMITED, Tokyo (JP)

(72) Inventors: Masahiro Tsuchiya, Tokyo (JP); Yukihiro Mori, Tokyo (JP); Sumio Watanabe, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 13/968,605

(22) Filed: Aug. 16, 2013

(65) Prior Publication Data

US 2014/0056633 A1 Feb. 27, 2014

(30) Foreign Application Priority Data

Aug. 23, 2012 (JP) ..... 2012-184502

(51) Int. Cl.

| | |
|---|---|
| ***B41J 11/70*** | (2006.01) |
| ***B41J 29/13*** | (2006.01) |
| ***B26D 1/08*** | (2006.01) |
| ***B26D 1/02*** | (2006.01) |
| ***B26D 1/04*** | (2006.01) |
| ***B26D 5/08*** | (2006.01) |
| *B26D 1/00* | (2006.01) |

(52) U.S. Cl.

CPC ..... *B41J 11/70* (2013.01); *B26D 1/085* (2013.01); *B41J 29/13* (2013.01); *B26D 1/025* (2013.01); *B26D 1/045* (2013.01); *B26D 5/086* (2013.01); *B26D 2001/0066* (2013.01)

(58) Field of Classification Search

CPC ..... B41J 11/66; B41J 11/70; B26D 1/085
USPC ..... 400/621, 691, 693; 347/157; 399/385; 83/694

See application file for complete search history.

(56) References Cited

U.S. PATENT DOCUMENTS

| | | | | |
|---|---|---|---|---|
| 6,361,231 | B1 * | 3/2002 | Sato et al. | 400/621 |
| 6,508,600 | B1 * | 1/2003 | Nonaka | 400/621 |
| 7,857,534 | B2 | 12/2010 | Watanabe et al. | |
| 7,876,346 | B2 * | 1/2011 | Watanabe et al. | 347/222 |
| 2003/0156882 | A1 * | 8/2003 | Song | 400/621 |
| 2004/0096256 | A1 * | 5/2004 | Hayashi et al. | 400/621 |
| 2011/0170931 | A1 * | 7/2011 | Kawaguchi | 400/621 |

FOREIGN PATENT DOCUMENTS

| | | |
|---|---|---|
| JP | 2683166 | 11/1997 |
| JP | 2004-106273 | 4/2004 |
| JP | 2007-130842 | 5/2007 |

* cited by examiner

*Primary Examiner* — Daniel J Colilla
(74) *Attorney, Agent, or Firm* — IPUSA, PLLC

(57) ABSTRACT

A printer includes a fixed blade block and a movable blade block. The fixed blade block includes an installing member including a rotation shaft, a fixed blade installed in the installing member, a retaining member, and a spring attached to the installing member in a rotatable state with respect to the rotation shaft. The spring includes a first contact part that contacts with the fixed blade and a second contact part that contacts with the retaining member. The movable blade block includes a movable blade that is movable toward the fixed blade. When the fixed blade block and the movable blade block are connected, the retaining member presses the second contact part, causing the spring to rotate and push the fixed blade toward the movable blade.

5 Claims, 13 Drawing Sheets

PRINTER APPARATUS INCLUDING A FIXED BLADE PUSHED TOWARD A MOVABLE BLADE

BACKGROUND OF THE INVENTION

1. Field of the Invention

The present invention generally relates to a printer apparatus.

2. Description of the Related Art

A printer that prints out receipts or the like is widely used for various purposes such as for a cash register of a store, or an ATM (Automated Teller Machine) or a CD (Cash Dispenser) of a bank. Such a printer includes a roll of heat sensitive paper to be used as recording paper. The printer prints, for example, letters on the recording paper by way of a thermal head or the like while the recording paper is conveyed. The recording paper is conveyed until the length of the recording paper reaches a predetermined length. Then, upon reaching the predetermined length, the recording paper is cut by a cutter.

A printer that cuts the recording paper with the cutter may have a fixed blade and a movable blade. By moving the movable blade toward the fixed blade, the recording paper is cut by the fixed blade and the movable blade.

[Patent Document 1]: Japanese Laid-Open Patent Publication No. 2004-106273

[Patent Document 2]: Japanese Laid-Open Patent Publication No. 2007-130842

[Patent Document 3]: Japanese Patent No. 2683166

A configuration of a printer 1000 that uses the fixed blade and the movable blade to cut a recording paper is described with reference to FIGS. 1A-2B.

As illustrated in FIG. 1A, the printer 1000 includes a printer head (e.g., thermal head) 910 and a platen roller 920. A recording paper 930 is conveyed between the printer head 910 and the platen roller 920. Printing is performed on the recording paper 903 while the recording paper 930 passes between the printer head 910 and the platen roller 920. The platen roller 920 rotates to pass the printed recording paper 930 between a fixed blade 941 and a movable blade 942 and the recording paper 930 is then discharged from the printer 1000. In the printer 1000 illustrated in FIGS. 1A and 1B, the fixed blade 941 and the platen roller 920 are attached toward an operation lever 950.

As illustrated in FIG. 1B, the movable blade 942 moves toward the fixed blade 941 when the printing is completed. That is, the movable blade 942 moves in a rightward direction in FIG. 1B. Thereby, the recording medium 930 between the movable blade 942 and the fixed blade 941 is cut. A spring is provided to exert force to the fixed blade 941 to cause the fixed blade 941 to exert force in an upward direction in FIG. 1B. That is, the fixed blade 941 exerts force toward the movable blade 942. After the recording paper 930 is cut, a restoring force of a spring causes the movable blade 942 to return to an initial position. That is, the restoring force causes the movable blade 942 to move in a leftward direction in FIG. 1B.

However, in a case where paper jam of the recording paper 930 occurs in which a recording paper 930*a* is jammed between the fixed blade 941 and the movable blade 942 as illustrated in FIG. 2A, the movable blade 942 cannot return to the initial position due to an upward force exerted from the spring to the fixed blade 941.

In this case, the operation lever 950 may be operated to remove the recording paper 930*a* jammed between the fixed blade 941 and the movable blade 942. However, even if the operation lever 950 is pressed downward (arrow direction A in FIG. 2B), the recording paper 930*a* cannot be removed due to a pressing force exerted to the movable blade 942 from the fixed blade 941.

SUMMARY OF THE INVENTION

An aspect of the present invention provides a printer including a fixed blade block and a movable blade block. The fixed blade block includes an installing member including a rotation shaft, a fixed blade installed in the installing member, a retaining member, and a spring attached to the installing member in a rotatable state with respect to the rotation shaft. The spring includes a first contact part that contacts with the fixed blade and a second contact part that contacts with the retaining member. The movable blade block includes a movable blade that is movable toward the fixed blade. When the fixed blade block and the movable blade block are connected, the retaining member presses the second contact part, causing the spring to rotate and push the fixed blade toward the movable blade.

Other objects and further features of the present invention will be apparent from the following detailed description when read in conjunction with the accompanying drawings.

DESCRIPTION OF EMBODIMENTS

In the following, embodiments of the present invention are described with reference to the accompanying drawings.

(Structure of Printer)

Figure 1A:
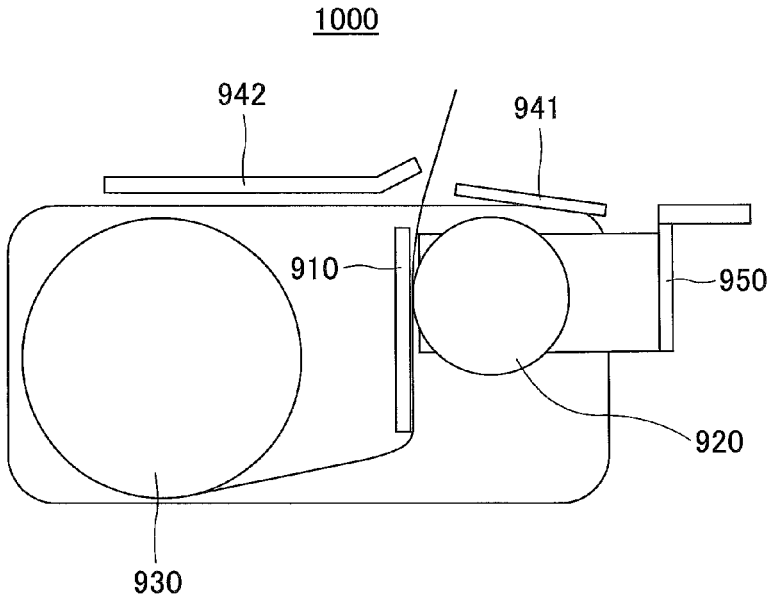
FIG.1A RELATED ART
FIGS. 1A-2B are schematic diagrams for describing a printer apparatus according to a related art.
Figure 1B:
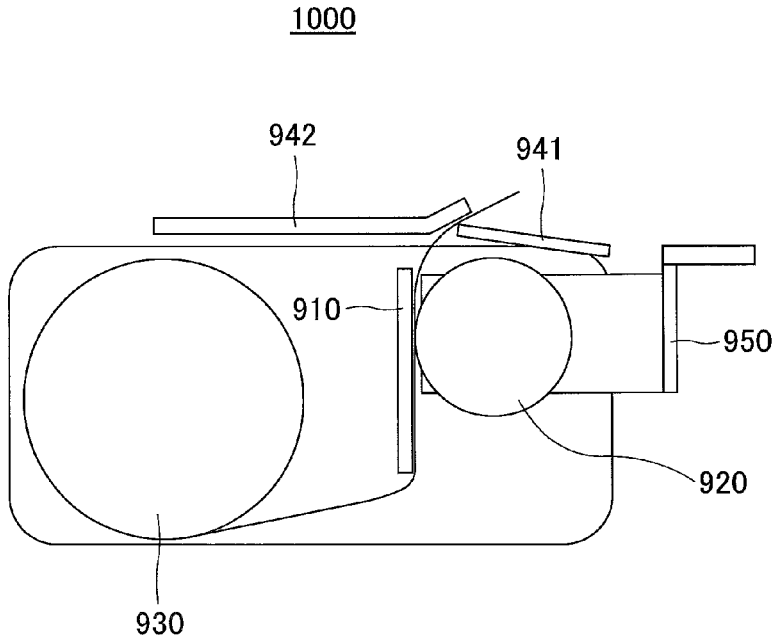
FIG.1B RELATED ART
Figure 2A:
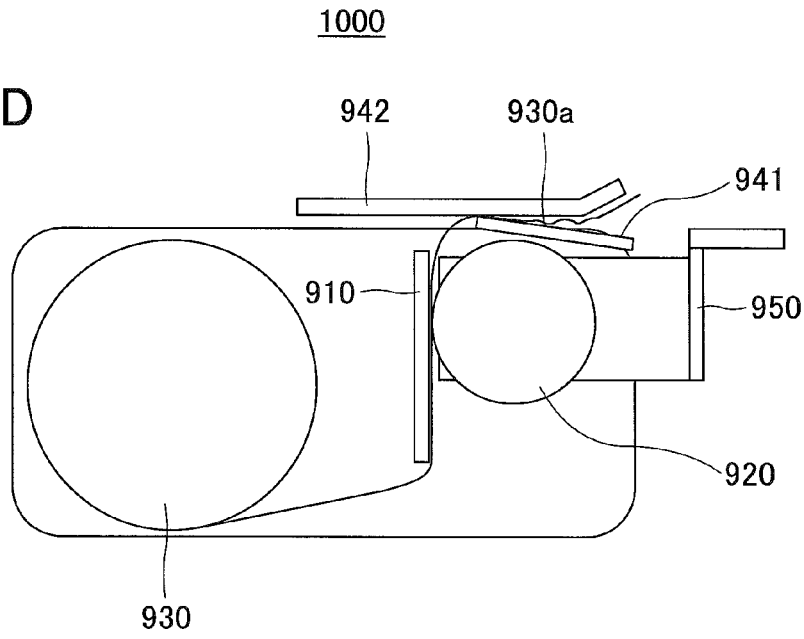
FIG.2A RELATED ART
Figure 2B:
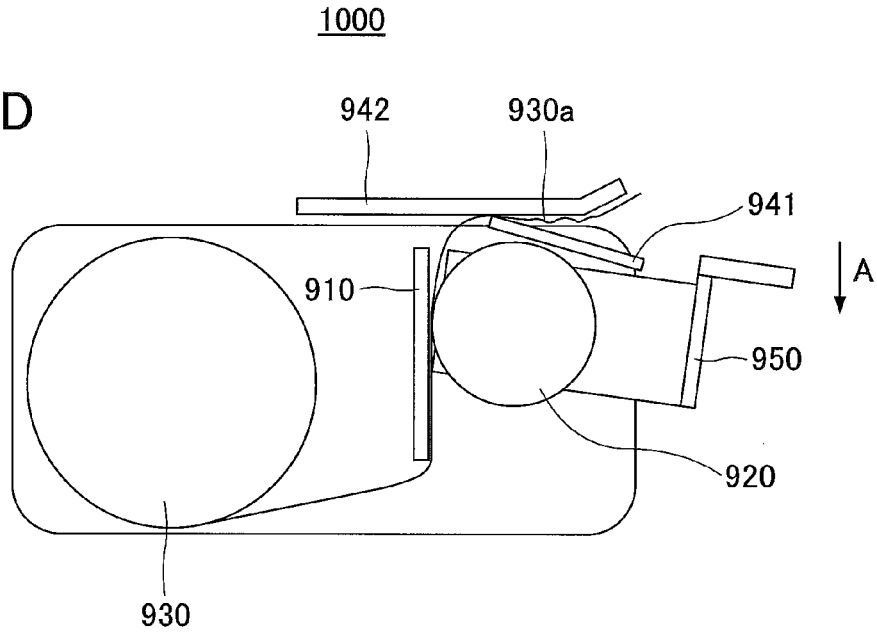
FIG.2B RELATED ART
Figure 3:
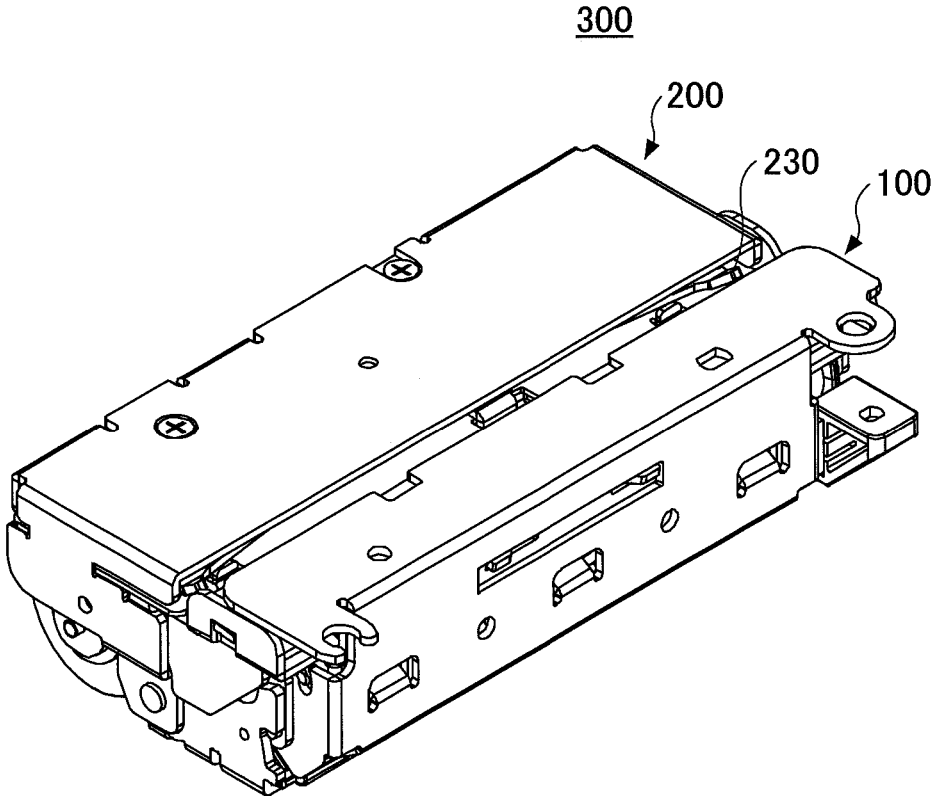
FIGS. 3-4 are schematic diagrams for describing a configuration of a portion of a printer apparatus according to an embodiment of the present invention.
Figure 4:
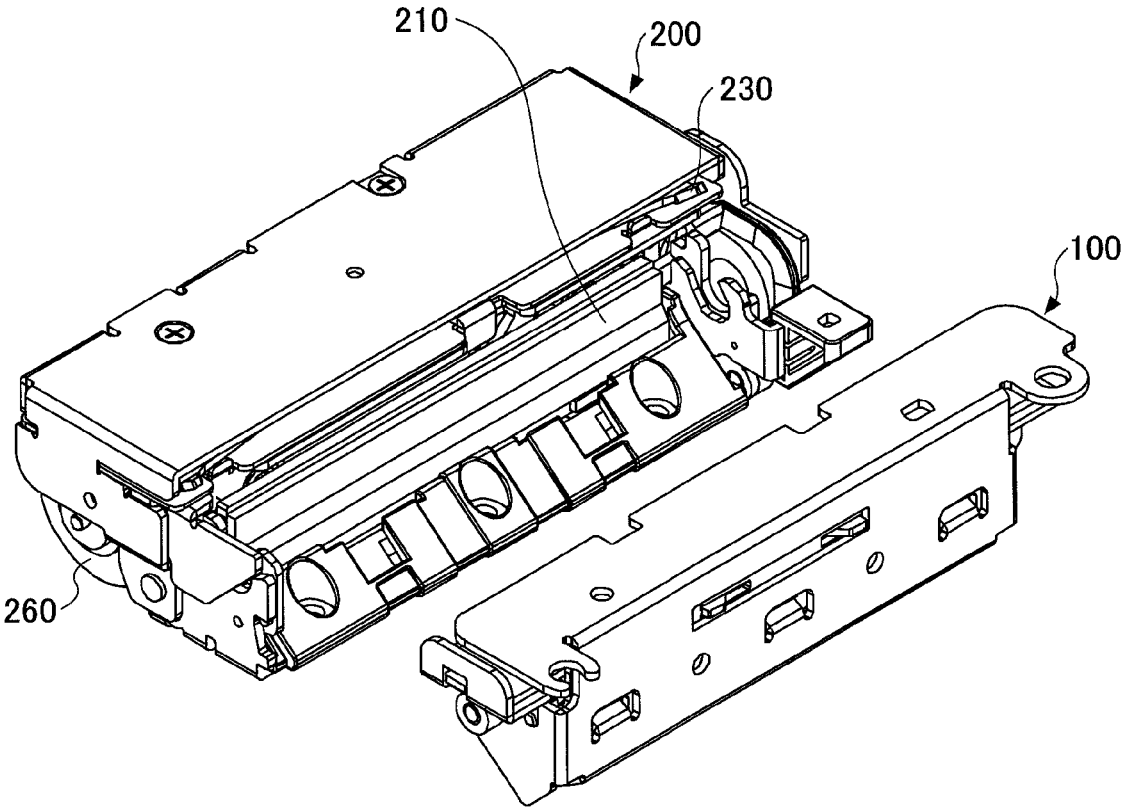

A printer apparatus 300 according to an embodiment of the present invention is described. As illustrated in FIGS. 3 and 4, the printer apparatus 300 includes a fixed blade block 100 and a movable blade block 200. The printer apparatus 300 may also include a printer body 500 and a cover 600 (see, for example, FIG. 11A). When a recording paper (not illustrated) is set in the printer body 500, the printer apparatus 300 is used in a state where the cover 600 is closed.

Figure 11A:
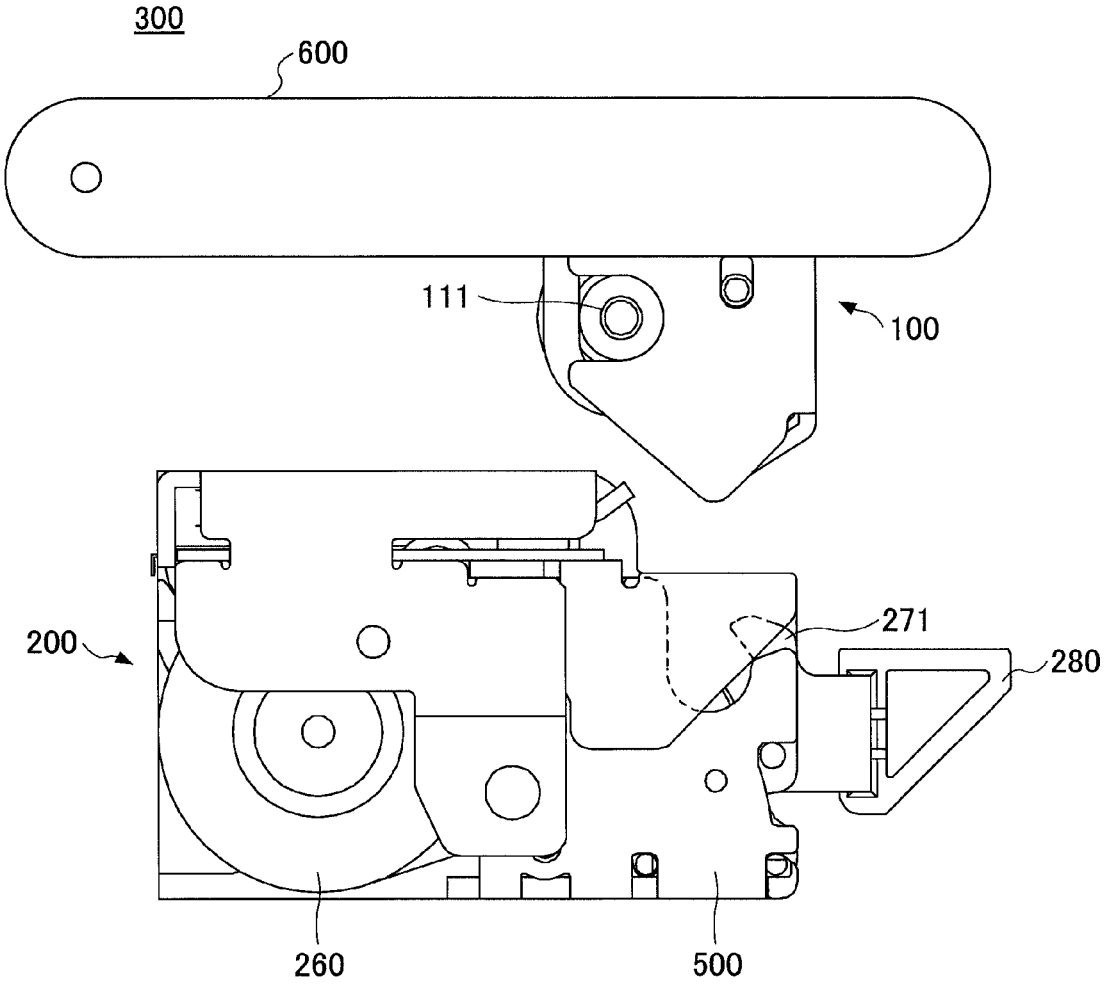
FIGS. 11A-17 are schematic diagrams for describing a printer apparatus according to an embodiment of the present invention.

The movable blade block 200 is attached to the printer body 500 (see, for example, FIG. 11A). The movable blade block 200 includes, for example, a thermal head 210, a movable blade 230, and a motor 260 for driving the movable blade 230. The movable blade block 200 also includes a spring (not illustrated) that has a restoring force for causing the movable blade 230 to return to an initial position. The recording paper (not illustrated), which is rolled, is provided on a side of the fixed blade block 100.

Figure 5:
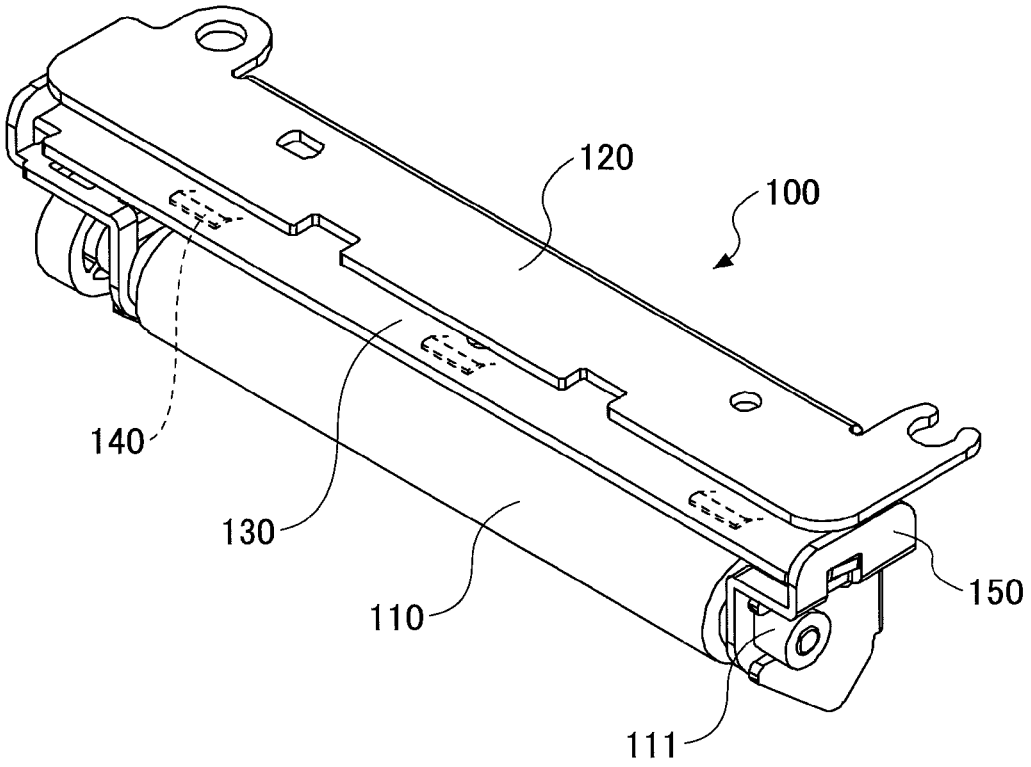
FIGS. 5-6 are schematic diagrams for describing a fixed blade block according to an embodiment of the present invention.
Figure 6:
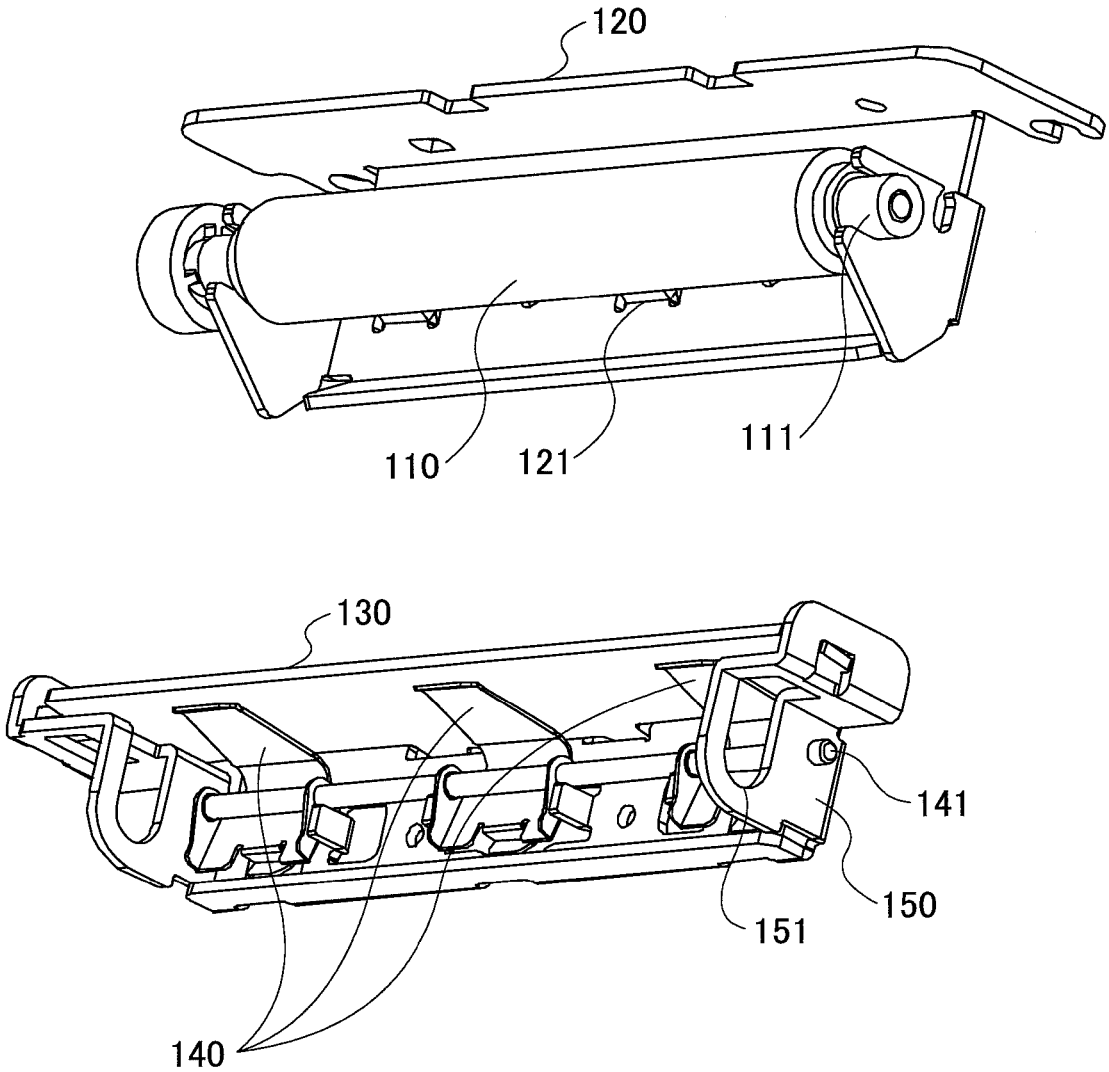

As illustrated in FIGS. 5, 6, and 11A, the fixed blade block 100 is attached to the cover 600 of the printer apparatus 300. The fixed blade block 100 includes, for example, a platen roller 110, a platen roller retaining member 120 (hereinafter referred to as "retaining member"), a fixed blade 130, a fixed blade spring 140, and a fixed blade installing member 150 (hereinafter referred to as "installing member"). The retaining member 120 retains a bearing 111 of the platen roller 110, so that the platen roller 110 can rotate around the bearing 111. The fixed blade 130 is installed in the installing member 150. Further, the installing member 150 includes a fixed blade spring rotation shaft 141 (hereinafter referred to as "rotation shaft 141") and retains the fixed blade spring 140, so that the fixed blade spring 140 can rotate with the rotation shaft 141 as a center of its rotation. Further, the retaining member 120 also includes a spring depressing part 121 that contacts an end part of the fixed blade spring 140 (described in detail below). The installing member 150 includes an opening 151 that allows the bearing 111 of the platen roller 110 to move in a vertical direction.

(Movable Blade and Fixed Blade)

Figure 7:
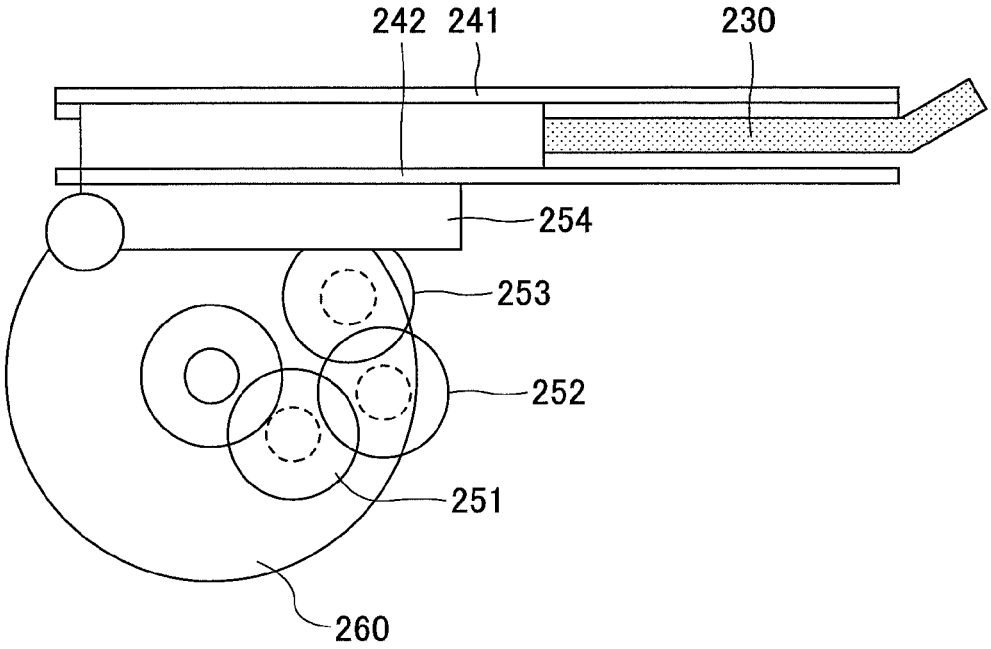
FIGS. 7-8 are schematic diagrams illustrating a configuration of a movable blade according to an embodiment of the present invention.
Figure 8:
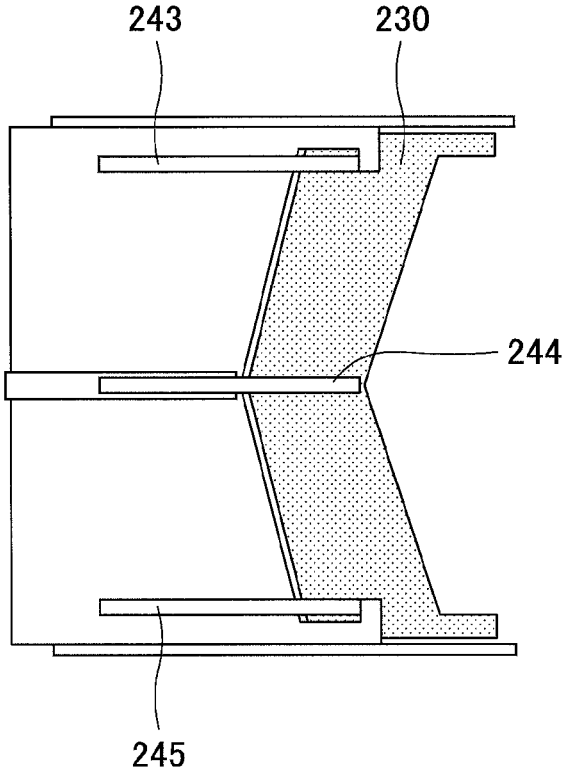

Next, the movable blade 230 and the fixed blade 130 according to the embodiment are described with reference to FIGS. 7 and 8. FIG. 7 is a side view illustrating the movable blade 230 according to the embodiment. FIG. 8 is a plan view illustrating the movable blade 230 according to the embodiment. A cover part 241 is provided above the movable blade 230. A cover part 242 is provided below the movable blade 230. The movable blade 230 is moved in a rightward direction in FIGS. 7 and 8 by a driving force transmitted from the motor 260 to the movable blade 230 via a driving gear 251, a transmitting gear 252, a conveying gear 253, and a delivering part 254. The cover part 241 provided above the movable blade 230 includes slide rails 243, 244, 245 that allow the movable blade 230 to move along the slide rails 243, 244, 245. A home-position spring (not illustrated) is connected to the movable blade 230 for returning the movable blade 230 to an initial position (home position) after the recording paper (not illustrated) is cut. That is, the home-position spring has a restoring force that causes the movable blade 230 to move in a leftward direction in FIGS. 7 and 8.

Figure 9:
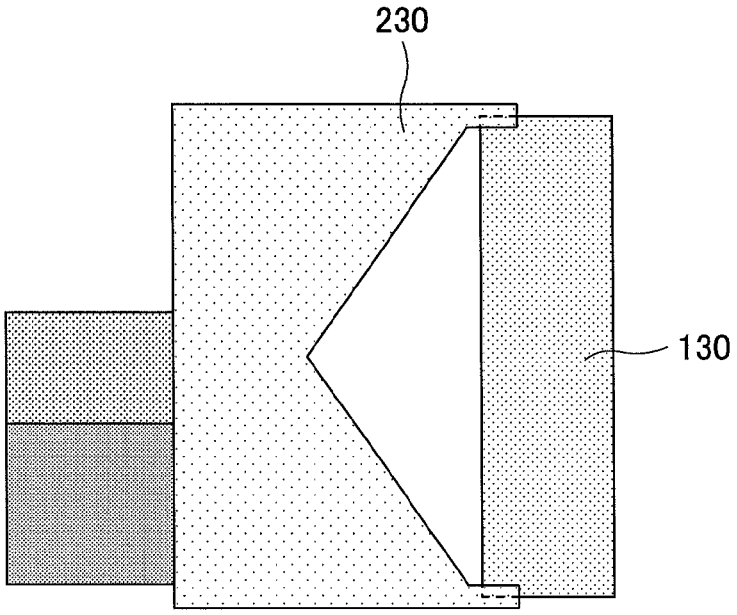
FIGS. 9-10 are schematic diagrams for describing a movable blade according to an embodiment of the present invention.
Figure 10:
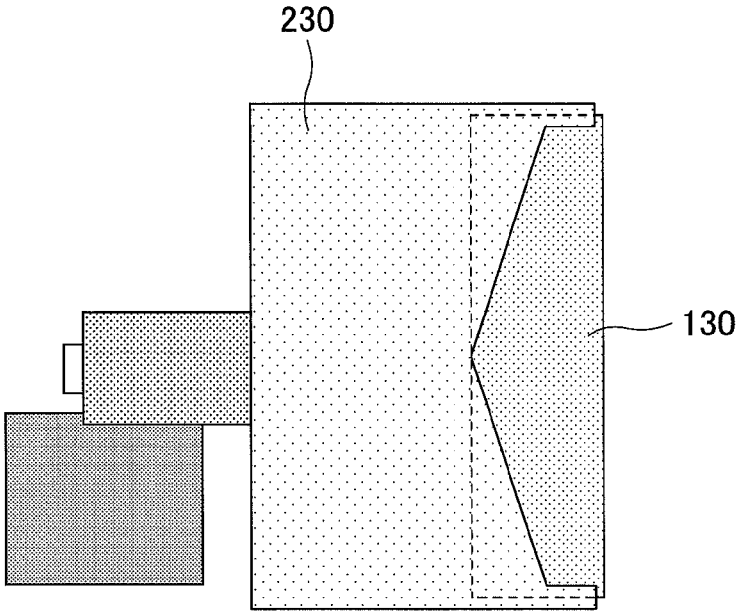

In a case of cutting the recording paper with the fixed blade 130 and the movable blade 230, the motor 260 is driven, so that the movable blade 230 is moved toward the fixed blade 130 from the state illustrated in FIG. 9 to the state illustrated in FIG. 10. That is, the movable blade 230 is moved in a rightward direction in FIGS. 9 and 10. Thereby, the recording paper is cut by the fixed blade 130 and the movable blade 230.

Then, the driving of the motor 260 is stopped, so that the movable blade 230 is moved in a leftward direction in FIGS. 9 and 10 and returned to its initial position by the restoring force of the home-position spring (not illustrated). That is, the movable blade 230 is moved from the state illustrated in FIG. 10 to the state illustrated in FIG. 9. Hence, in the above-described manner, the recording paper can be cut by using the fixed blade 130 and the movable blade 230. Alternatively, instead of using the restoring force of the home-position spring, the movable blade 230 may be moved in the leftward direction and returned to its initial position by rotating the motor 260 in a reverse direction.

(Connection Between Fixed Blade Block and Movable Blade Block)

Next, an example of connecting the fixed blade block 100 and the movable blade block 200 is described with reference to FIGS. 11A to 17. The fixed blade block 100 and the movable blade block 200 are connected by closing the cover 600 attached to the printer body 500.

Figure 11B:
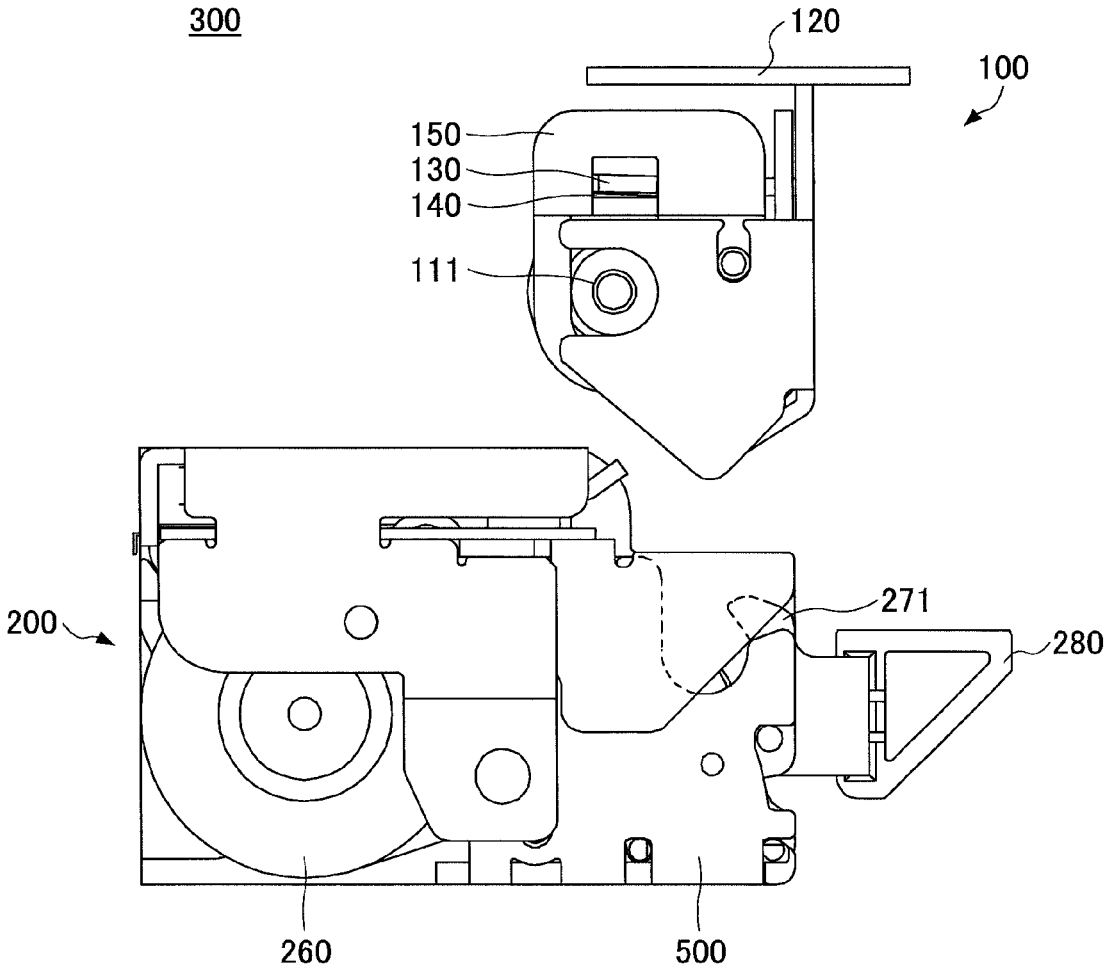
Figure 12:
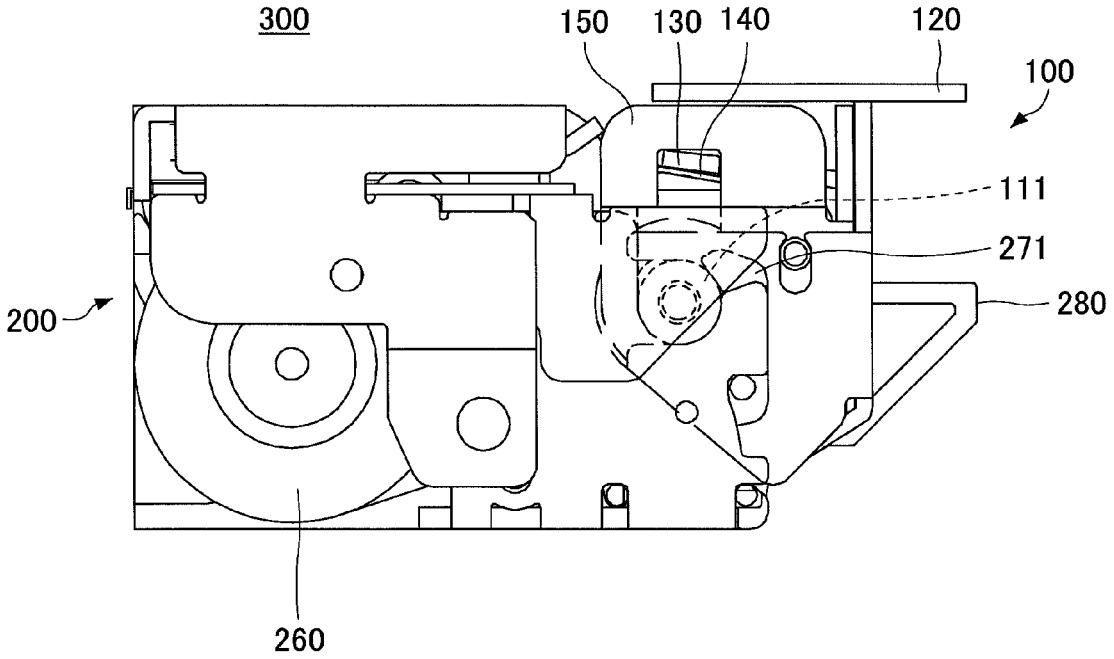

FIGS. 11A-12 are schematic diagrams for describing the connection between the fixed blade block 100 and the movable blade block 200 of the printer apparatus 300. For the sake of convenience, FIGS. 11B and 12 illustrate the printer apparatus 300 of FIG. 11A without the cover 600.

As illustrated in FIG. 11A, the fixed blade block 100 and the movable blade block 200 do not contact each other in a state where the cover 600 to which the printer body 500 is attached is in an open state. Then, by closing the cover 600, the fixed blade block 100 and the movable blade block 200 are connected. In the state where the fixed blade block 100 and the movable blade block 200 are connected as illustrated in FIG. 12, the bearing 111 of the platen roller 110 provided in the fixed blade block 100 is retained by a lock arm provided in the movable blade block 200.

Figure 13:
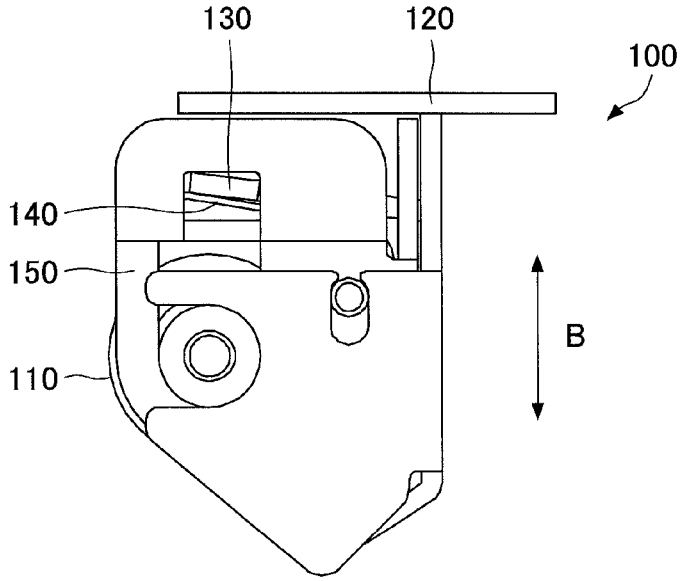
Figure 14:
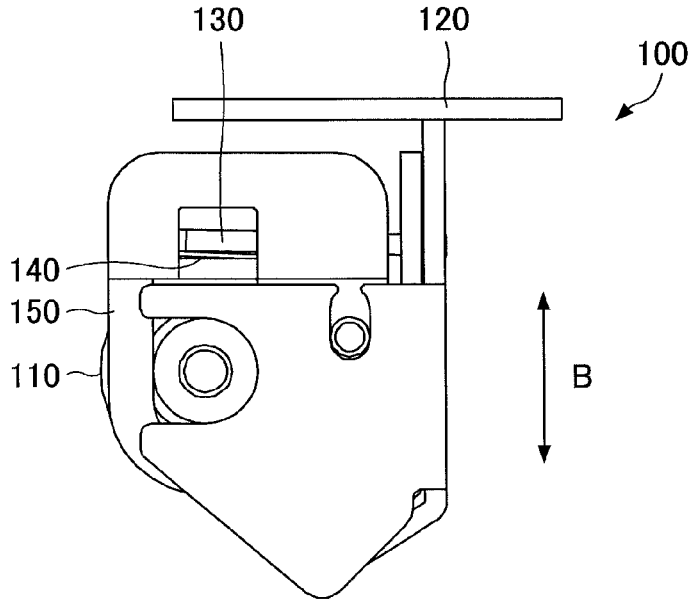
Figure 15:
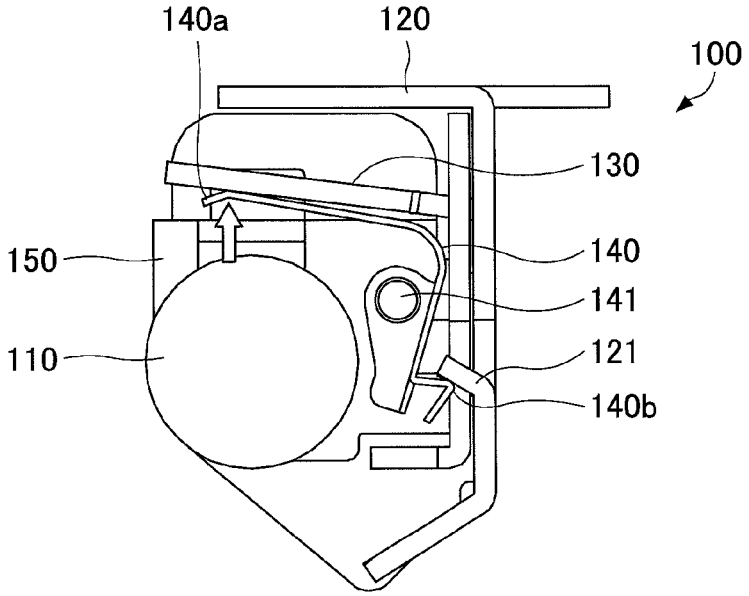

As illustrated in FIGS. 13 and 14, the fixed blade block 100 is formed to allow the retaining member 120 to move in a vertical direction (i.e. arrow direction B in FIGS. 13 and 14) with respect to the installing member 150. Further, as illustrated in FIG. 15, the fixed blade spring 140 is attached to the installing member 150 in a manner that the fixed blade spring 140 can rotate with the rotation shaft 141 as the center of rotation. It is to be noted that FIG. 15 is a cross-sectional view corresponding to the state illustrated in FIG. 13. The fixed blade spring 140 includes contact parts 140*a* and 140*b*. The contact part 140*a*, which contacts a back surface of the fixed blade 130, is provided in a vicinity of a first end part of the fixed blade spring 140. The contact part 140*b*, which contacts the spring depressing part 121 provided in the retaining member 120, is provided in a vicinity of a second end part of the fixed blade spring 140.

By closing the cover 600 attached to the printer body 500, the retaining member 120 moves in a downward direction (see arrow B in FIG. 13) with respect to the installing member 150 as illustrated in FIG. 13. Thereby, the contact part 140*b* provided in the vicinity of the second end part of the fixed blade spring 140 is depressed by the spring depressing part 121 provided in the retaining member 120 as illustrated in FIG. 15. By depressing the contact part 140*b* with the spring depressing part 121, the fixed blade spring 140 rotates in a clockwise direction with the rotation shaft 141 as a center of rotation. The contact part 140*a* presses the fixed blade 130 upward from a back side.

Thus, by pressing the fixed blade 130 in the above-described manner, a space between a distal end part of the fixed blade 130 and a distal end part of the movable blade 230 in a height direction of the fixed blade 130 and the movable blade 230 (i.e., in the vertical direction of, for example, FIG. 12) becomes substantially zero, and a recording paper nipped between the fixed blade 130 and the movable blade 230 can be cut. It is to be noted that the recording paper cannot be satisfactorily nipped between the fixed blade 130 and the movable blade 230 in a case where the space between the distal end part of the fixed blade 130 and the distal end part of the movable blade 230 is wide. In such a case, the recording paper cannot be cut by the fixed blade 130 and the movable blade 230.

Figure 16:
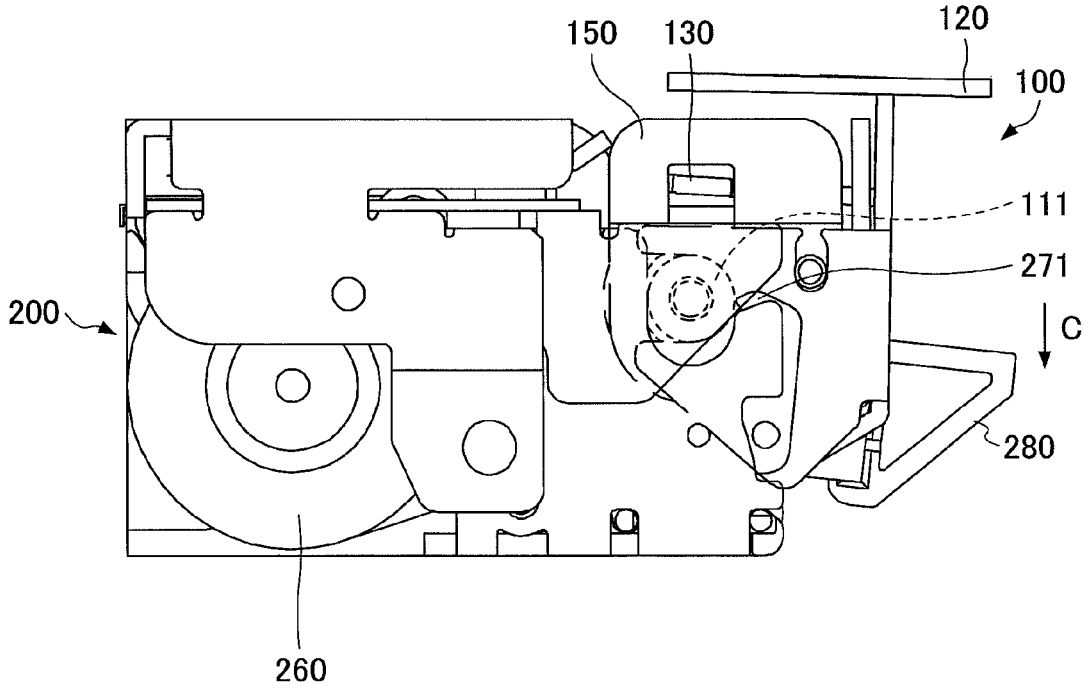
Figure 17:
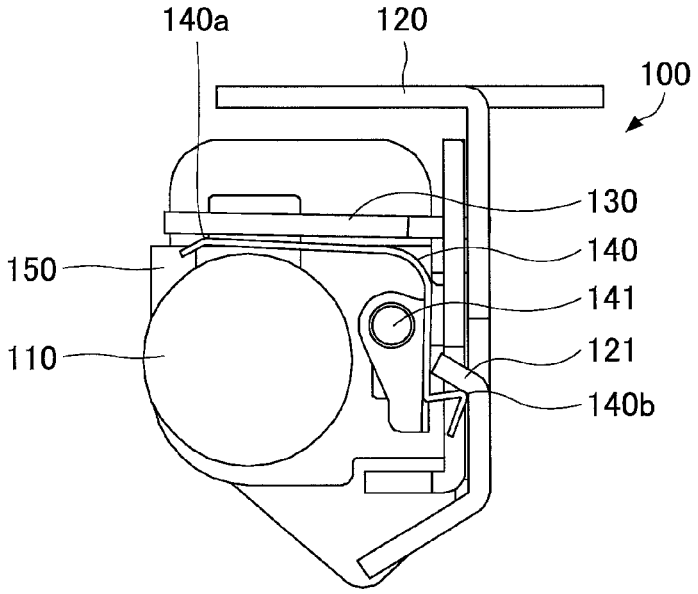

In a case where a recording paper is jammed between the fixed blade 130 and the movable blade 230 (paper jam) when cutting the recording paper is cut by the fixed blade 130 and the movable blade 230, an operation lever 280 is pressed downward (arrow direction C in FIG. 16) in order to open the cover 600 of the printer apparatus 300 as illustrated in FIG. 16. By pressing the operation lever 280 downward, the bearing 111 of the platen roller 110 is released from the lock arm 271 provided in the movable blade block 200. As illustrated in FIG. 17, the retaining member 120 moves upward with respect to the installing member 150 substantially at the same time in which the bearing 111 is released from the lock arm 271. It is to be noted that FIG. 17 is a cross-sectional view corresponding to the state illustrated in FIG. 14.

Thus, by moving the retaining member 120 upward with respect to the installing member 150, a depressing force exerted from the spring depressing part 121 of the retaining member 120 to the contact part 140*b* of the fixed blade spring 140 is reduced or eliminated. Thereby, the fixed blade spring 140 rotates in a counter-clockwise direction with the rotation shaft 141 as its center of rotation. Further, the contact part 140*a* contacting the fixed blade 130 is separated from the fixed blade 130. Thus, a pressing force is no longer exerted from the fixed blade spring 140 to the fixed blade 130. Accordingly, the restoring force of the home-position spring (not illustrated) causes the movable blade 230 to return to its initial position since the fixed blade 130 moves downward. As a result, the space between the fixed blade 130 and the movable blade 230 opens to allow the recording paper jammed between the fixed blade 130 and the movable blade 230 to be removed. Alternatively, instead of using the restoring force of the home-position spring, the movable blade 230 may be returned to its initial position by rotating the motor 260 in a reverse direction.

The present invention is not limited to these embodiments, but variations and modifications may be made without departing from the scope of the present invention.

The present application is based on and claims benefit of priority of Japanese Priority Application No.2012-184502 filed on Aug. 23, 2012, with the Japanese Patent Office, the entire contents of which are hereby incorporated by reference.

What is claimed is:

1. A printer, comprising:

a fixed blade block including an installing member including a rotation shaft, a fixed blade installed in the installing member, a retaining member that is movable with respect to the installing member, and a spring attached to the installing member, the spring includes a first contact part that contacts with the fixed blade and a second contact part that contacts with the retaining member; and a movable blade block including a movable blade that is movable toward the fixed blade;

wherein, when the fixed blade block and the movable blade block are connected and the retaining member moves in a first direction with respect to the installing member, the retaining member presses the second contact part and causes the spring to push the fixed blade toward the movable blade, and when the retaining member moves in a second direction opposite to the first direction with respect to the installing member, a pressing force exerted from the retaining member to the second contact part is reduced and causes a space between the fixed blade and the movable blade to be opened.

2. The printer as claimed in claim 1, further comprising:

a printer body; and a cover attached to the printer body and configured to open and close with respect to the printer body;

wherein the movable blade block is attached to the printer body, the cover is attached to the fixed blade block, and the fixed blade block and the movable blade block are connected by closing the cover with respect to the printer body.

3. The printer as claimed in claim 1, wherein the retaining member includes a spring depressing part that depresses the second contact part.

4. The printer as claimed in claim 2, further comprising:

an operation lever configured to open the cover;

wherein the pressing force exerted to the second contact part is reduced by pressing the operation lever, and a reduction of the pressing force reduces a force that causes the fixed blade spring to push the fixed blade via the first contact part.

5. The printer as claimed in claim 2, further comprising:

an operation lever configured to open the cover;

wherein the movable blade is configured to return to an initial position by pressing the operation lever.

* * * * *